US006779352B2

(12) United States Patent
Jeong

(10) Patent No.: US 6,779,352 B2
(45) Date of Patent: Aug. 24, 2004

(54) REFRIGERATOR AND METHOD OF CONTROLLING THE SAME

(75) Inventor: Seong-Wook Jeong, Kwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/281,150

(22) Filed: Oct. 28, 2002

(65) Prior Publication Data

US 2003/0131614 A1 Jul. 17, 2003

(30) Foreign Application Priority Data

Jan. 14, 2002 (KR) ..... 2002-1974
Oct. 4, 2002 (KR) ..... 10-2002-0060510

(51) Int. Cl.[7] ..... F25D 21/06
(52) U.S. Cl. ..... 62/156; 62/140
(58) Field of Search ..... 62/151, 155, 156, 62/128, 140, 152, 80, 81

(56) References Cited

U.S. PATENT DOCUMENTS 3,214,930 A * 11/1965 Laporte ..... 62/156
3,335,576 A * 8/1967 Phillips ..... 62/156
3,861,167 A * 1/1975 Nijo ..... 62/209
4,346,564 A 8/1982 Gemma et al.
6,606,870 B2 * 8/2003 Holmes et al. ..... 62/155

* cited by examiner

*Primary Examiner*—Harry B. Tanner
(74) *Attorney, Agent, or Firm*—Staas & Halsey LLP

(57) ABSTRACT

A refrigerator which uses a microcomputer having a common input port for a plurality of temperature sensing devices, and a method of controlling the same. In the refrigerator, inexpensive bimetals are used as one or more of the temperature sensing devices to sense a defrost temperature of the refrigerator. Accordingly, the manufacturing cost of the refrigerator is reduced. Furthermore, because the refrigerator is provided with the common input port for the temperature sensing devices, a circuit construction thereof is simplified.

27 Claims, 7 Drawing Sheets

REFRIGERATOR AND METHOD OF CONTROLLING THE SAME

CROSS-REFERENCE TO RELATED APPLICATIONS

This application claims the benefit of Korean Application No. 2002-1974, filed Jan. 14, 2002, and Application No. 2002-60510, filed Oct. 4, 2002, in the Korean Intellectual Property Office, the disclosures of which are incorporated herein by reference.

BACKGROUND OF THE INVENTION

1. Field of the Invention

The present invention relates to a refrigerator and a method of controlling the same, and more particularly, to a refrigerator which performs a defrosting operation using a microcomputer having a common input port and a plurality of bimetals, and a method of controlling the same.

2. Description of the Related Art

Generally, refrigerators prevent the decomposition of foods stored therein and maintain the freshness of the foods for a lengthy period of time by compulsorily supplying cool air generated from an evaporator to a refrigerator compartment using a fan.

In such a refrigerator, an evaporator and a fan which generate cool air and supply the cool air to a freezer compartment and a refrigerator compartment are installed in a back portion of a body. That is, the evaporator and the fan perform a cooling operation by supplying the cool air to the freezer compartment and the refrigerator compartment. Alternatively, a refrigerator may have an evaporator and a fan for each of a freezer compartment and a refrigerator compartment. The evaporators and the fans perform a cooling operation by independently supplying cool air to the corresponding freezer compartment and the refrigerator compartment. In either of the above refrigerators, a defrosting operation to eliminate frost, which is stuck to an evaporator, is performed by driving a defrost heater arranged on the evaporator.

The defrosting operation is carried out under a control of a microcomputer which entirely controls a refrigerator. The defrosting operation is performed such that defrosting conditions to determine whether the defrosting operation is performed are previously set, and the defrost heater is driven in response to the corresponding defrosting conditions being satisfied.

The conventional refrigerator, as described above, is constructed such that after the defrost heater is driven to start a defrosting operation, the microcomputer receives a defrost temperature (a surface temperature of an evaporator) sensed through a temperature sensor mounted on the evaporator, and stops the driving of the defrost heater where the sensed defrost temperature reaches a set temperature.

FIG. 1A shows a conventional refrigerator, and FIG. 1B shows a flowchart to illustrate a method of controlling the refrigerator of FIG. 1A.

As shown in FIG. 1A, the refrigerator includes a thermistor TH which is mounted on an evaporator (not shown) and has a resistance that varies according to a defrost temperature, a voltage dividing resistor Ra which is connected to the thermistor TH, and a resistor Rb and a capacitor Ca which are connected to an input port P1 of a microcomputer 1. The resistor Rb and the capacitor Ca drop a voltage divided by the resistor Ra and stabilize the voltage.

With reference to FIG. 1B, a defrosting operation of the refrigerator shown in FIG. 1A will be described below.

Where defrosting operating conditions are satisfied, the microcomputer 1 turns on a defrost heater (not shown) so as to start a defrosting operation, in operation 10. A defrost temperature increases due to a heat generated by the defrost heater, and accordingly, the heat melts frost stuck to the evaporator. In this case, a voltage corresponding to a resistance value of the thermistor TH, which is varied according to the defrost temperature, is input to the input port P1 of the microcomputer 1 in operation 20. The microcomputer 1 converts the input voltage detected through the input port P1 into digital temperature data, and calculates a defrost temperature on the basis of the digital temperature data in operation 30.

The microcomputer 1 determines whether the calculated defrost temperature corresponds to a set temperature, that is, a defrosting stop temperature, to stop the defrosting operation, in operation 40. Where the calculated defrost temperature does not correspond to the defrosting stop temperature in the operation 40, the microcomputer 1 continues to perform the defrosting operation. Where the calculated defrost temperature corresponds to the defrosting stop temperature, the microcomputer 1 turns off the defrost heater so as to stop the defrosting operation, in operation 50, and returns to an operation of cooling respective compartments of the refrigerator.

However, the conventional refrigerator is problematic in that it senses a defrost temperature using a single thermistor TH mounted on the evaporator. Accordingly, inexact defrost temperature may be sensed, causing a defrosting operation to be stopped prematurely, and leaving some of the frost still stuck to a portion of the evaporator.

In view of the above, FIG. 2 shows and Korean Patent No. 161925 (Korean Laid-Open Publication No. 1997-22128) discloses a method of checking a defrost temperature that is close to an actual temperature of an evaporator 2 by mounting defrost temperature sensors 6*a* and 6*b* on both side portions of the evaporator 2. The temperature sensors 6*a* and 6*b* are used to more accurately sense a surface temperature of the evaporator 2.

However, the conventional refrigerator of FIG. 2, as described above, has a complicated construction and is costly to manufacture. That is, in addition to expensive temperature sensors, a microcomputer of the refrigerator necessarily has additional input ports that are connected to the respective temperature sensors. In other words, as the number of added temperature sensors is increased, the number of the input ports of the microcomputer is increased proportionally in the conventional refrigerator. Accordingly, the refrigerator having the above structure also has a complicated circuit construction that performs a defrost temperature sensing operation.

SUMMARY OF THE INVENTION

Accordingly, it is an aspect of the present invention to provide a refrigerator having a simplified circuit construction which checks a defrost temperature using one or more temperature sensing devices, and a method of controlling the same.

Additional aspects and advantages of the invention will be set forth in part in the description which follows and, in part, will be obvious from the description, or may be learned by practice of the invention.

To achieve the above and other aspects of the present invention, there is provided a refrigerator which performs a cooling operation and a defrosting operation, comprising an evaporator to perform the cooling operation, a defrost temperature sensing unit which includes a plurality of temperature sensing devices, wherein the temperature sensing devices are mounted on the evaporator to be spaced apart from each other and the defrost temperature sensing unit senses a defrost temperature using the temperature sensing devices, and a microcomputer having a common input port which receives the defrost temperature detected by the defrost temperature sensing unit.

To achieve the above and other aspects of the present invention, there is provided a method of controlling a refrigerator which senses a defrost temperature using a plurality of temperature sensing devices, which are mounted on an evaporator to be spaced apart from each other, and performs a defrosting operation to defrost the evaporator according to a control of a microcomputer having a common input port to receive the sensed defrost temperature, the method comprising determining operating states of the temperature sensing devices on the basis of the defrost temperature input through the common input port in the defrosting operation, and stopping the defrosting operation in response to the defrost temperature corresponding to defrosting stop conditions on the basis of determined results for the operating states of the temperature sensing devices.

In the present invention, one or more temperature sensing devices are mounted on the evaporator so as to sense a defrost temperature (a surface temperature of the evaporator). The temperature sensing devices may be implemented by bimetals having the same operating characteristics, or by two kinds of devices, for example, a thermistor and a bimetal, having different operating characteristics. The operating characteristics of the bimetals include being turned on or off according to the defrost temperature. The operating characteristics of the termistor include having a resistance thereof which is varied according to the defrost temperature.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1A:
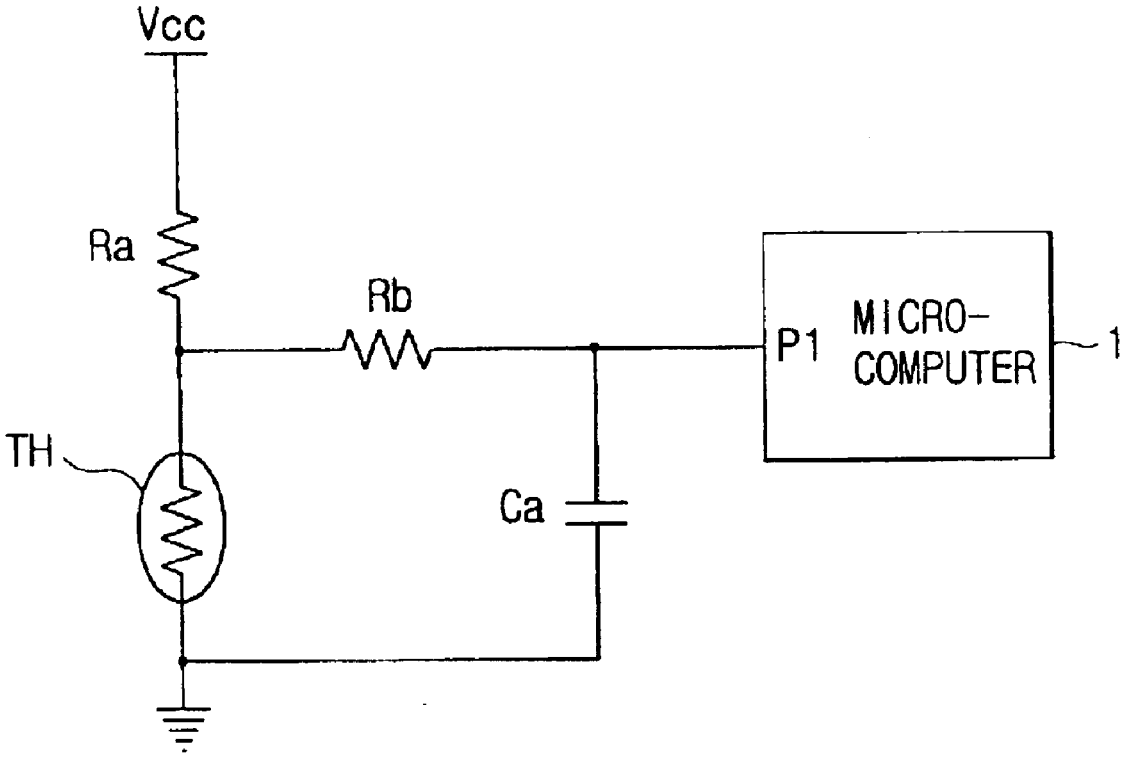
FIG. 1A (PRIOR ART)
FIG. 1A is a circuit diagram illustrating the construction of a conventional refrigerator.
Figure 1B:
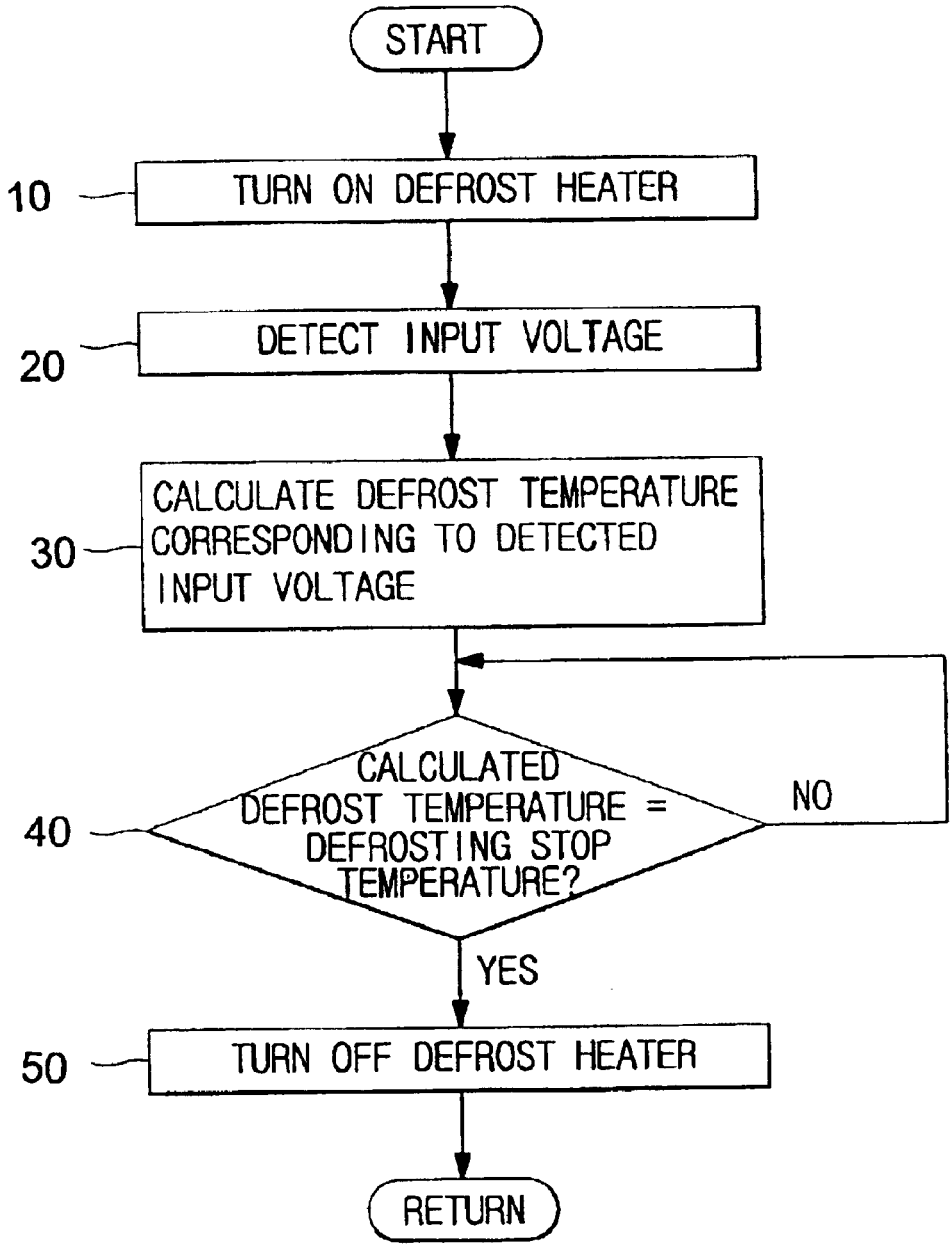
FIG. 1B (PRIOR ART)
FIG. 1B is a flowchart of a method of controlling the refrigerator shown in FIG. 1A.
Figure 2:
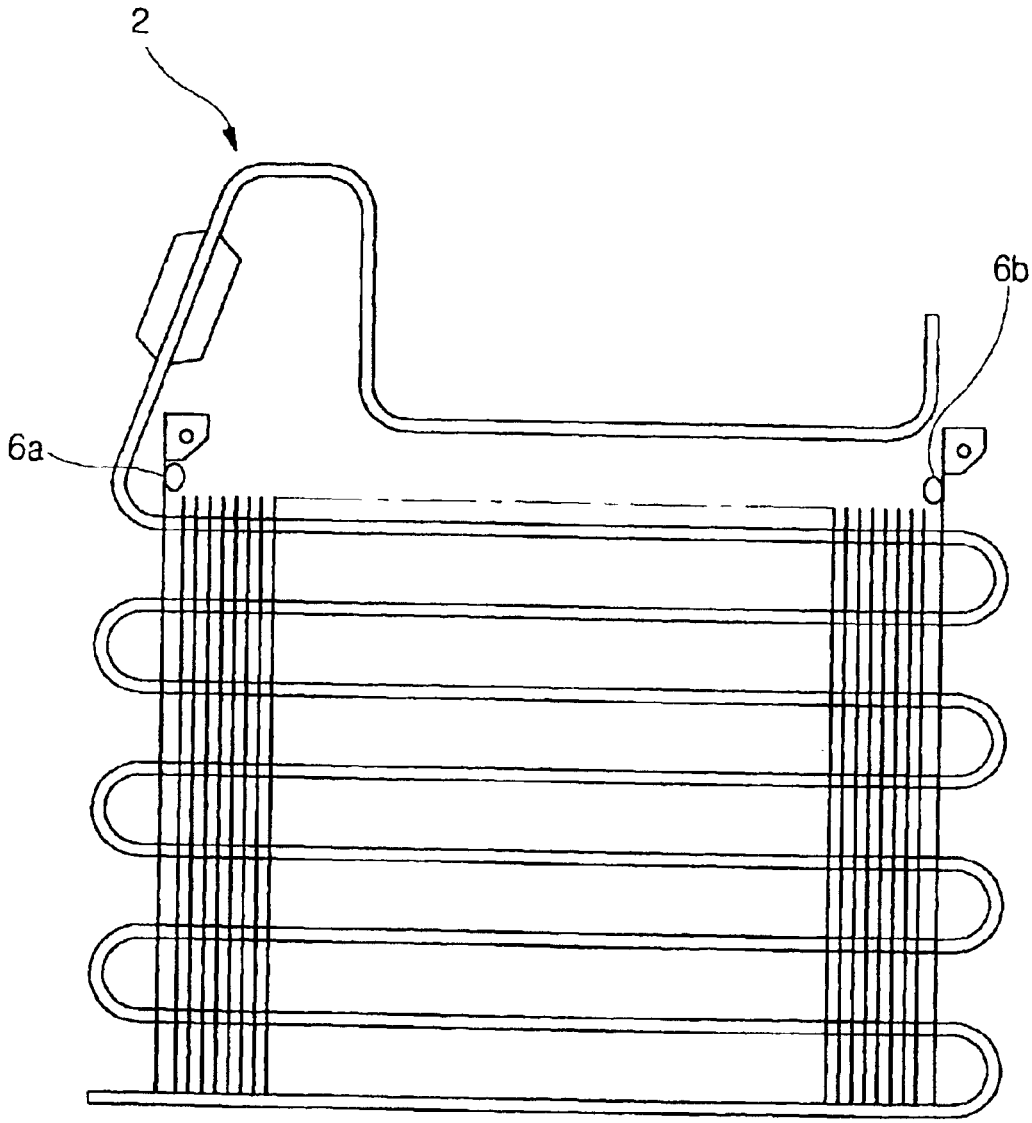
FIG. 2 (PRIOR ART)
FIG. 2 is a partial view showing the construction of another conventional refrigerator.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3A:
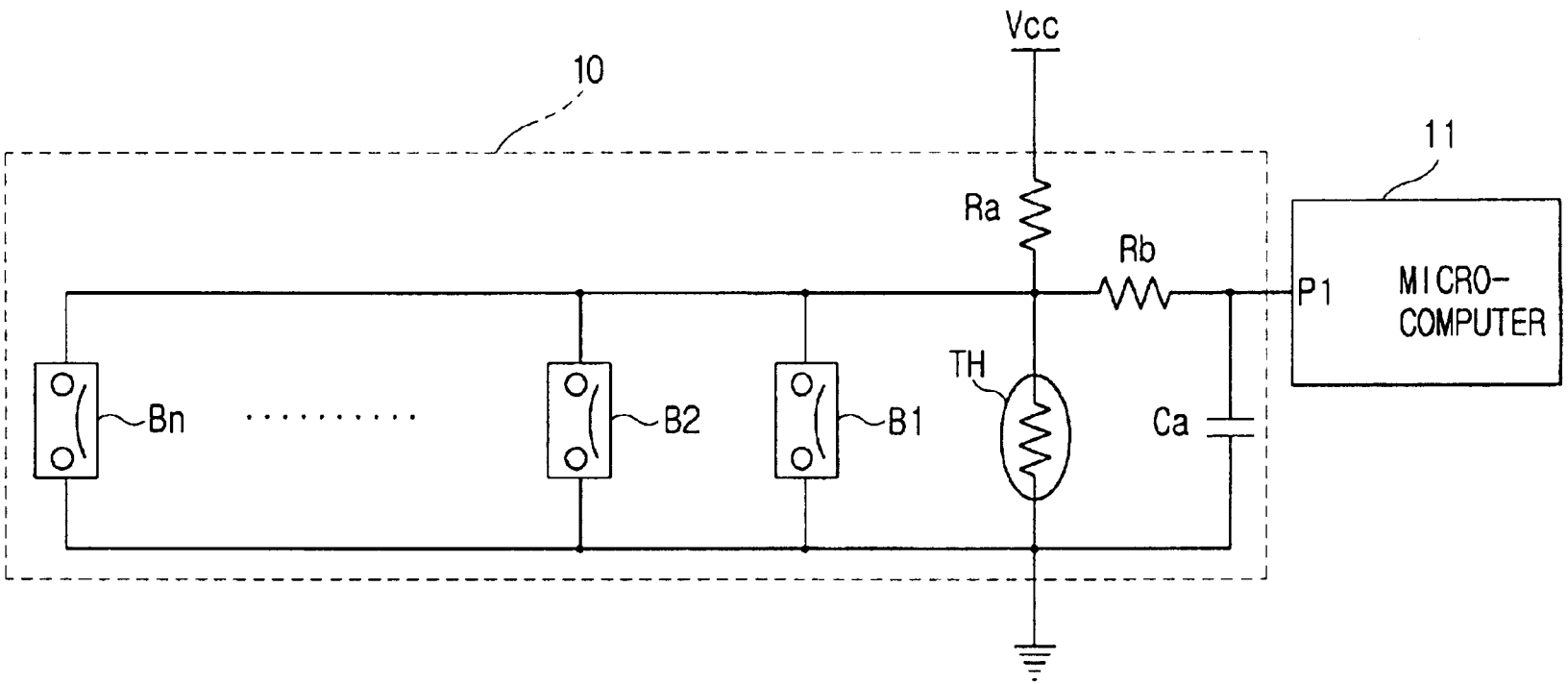
FIG. 3A is a circuit diagram illustrating the construction of a refrigerator according to an embodiment of the present invention.

FIG. 3A shows a circuit diagram illustrating the construction of a refrigerator according to an embodiment of the present invention. As shown in FIG. 3A, the refrigerator includes a thermistor TH and a plurality of bimetals (B1, B2 . . . Bn) which act as temperature sensing devices and are arranged apart from each other on an evaporator (not shown). The present invention is described on the basis of elements related to an operation of sensing a defrost temperature. Accordingly, typical elements of the refrigerator, including a defrost heater, are not depicted in FIG. 3A.

Referring to FIG. 3A, the refrigerator of the present invention includes a defrost temperature sensing unit 10 which senses a defrost temperature using the plurality of temperature sensing devices, where an operation of defrosting the evaporator is performed, and a microcomputer 11 having a single common input port P1 to receive the defrost temperature sensed by the defrost temperature sensing unit 10.

The defrost temperature sensing unit 10 includes the thermistor TH, the plurality of bimetals (B1, B2 . . . Bn), a voltage dividing resistor Ra, and a resistor Rb and a capacitor Ca which drop a voltage divided by the dividing resistor Ra and stabilize the voltage.

The thermistor TH and the plurality of bimetals (B1, B2 . . . Bn) are mounted on the evaporator to be spaced apart from each other, and sense a defrost temperature at the respective mounted positions. For example, the thermistor TH may be mounted at a position where a defrost temperature is varied latest, that is, an area of the evaporator where a defrost temperature is changed later than areas where the bimetals (B1, B2 . . . Bn) are positioned.

The thermistor TH is connected to the bimetals (B1, B2 . . . Bn) in parallel with each other. Each of the thermistor TH and the bimetals (B1, B2 . . . Bn) has one end connected to driving power Vcc through the voltage dividing resistor Ra, and the other end connected to a ground.

Where defrosting conditions are satisfied, the microcomputer 11 drives the defrost heater (not shown), and the defrost temperature (a surface temperature of the evaporator) increases due to a heat generated by the defrost heater. In this case, the bimetals (B1, B2 . . . Bn) maintain their turned-on states at an initial stage of a defrosting operation, and are switched to turned-off states in response to the defrosting temperature being increased to a predetermined temperature. Therefore, where even a single bimetal maintains its turned-on state, a current flows into the ground through the turned-on bimetal, so a voltage input to the input port P1 of the microcomputer 11 is maintained at the same state as that of the initial stage of the defrosting operation. Accordingly, the microcomputer 11 drives the defrost heater to continue the defrosting operation.

Where all of the bimetals (B1, B2 . . . Bn) are switched to the turned-off states, a divided voltage corresponding to a resistance of the thermistor TH, which is varied according to the defrost temperature, is input to the input port P1 of the microcomputer 11 through the resistor Rb and the capacitor Ca. The microcomputer 11 recognizes a defrost temperature corresponding to the voltage input through the input port P1, determines whether the defrost temperature corresponds to defrosting stop conditions by comparing the defrost temperature with a set temperature, and operates the defrost heater according to the determined results.

Accordingly, only after all of the bimetals (B1, B2 . . . Bn) are switched to the turned-off states, the defrosting operation of the microcomputer 11 is maintained or stopped in response to a voltage corresponding to the resistance of the thermistor TH, which is mounted at a position where the defrost temperature is last to be varied. Therefore, the present refrigerator prevents a premature stopping of a defrosting operation which leaves a part of frost still stuck to a portion of the evaporator.

Figure 3B:
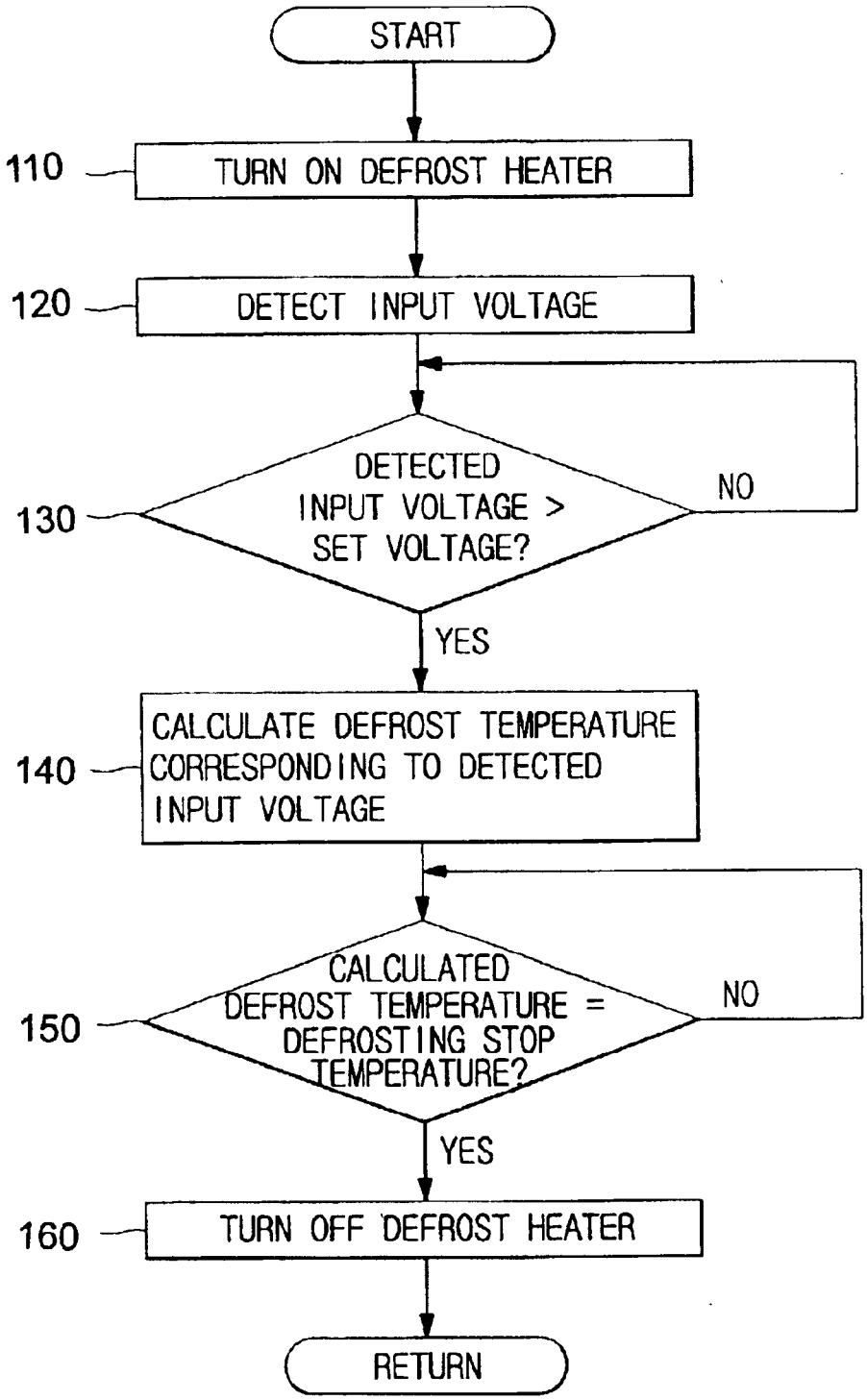
FIG. 3B is a flowchart of a method of controlling a refrigerator according to the present invention.

FIG. 3B shows a flowchart illustrating a method of controlling the refrigerator having the above construction.

Where defrosting conditions are satisfied, the microcomputer 11 turns on the defrost heater (not shown) to start a defrosting operation, in operation 110. In this case, a defrost temperature increases due to a heat generated by the defrost heater to melt frost stuck to the evaporator, and the bimetals (B1, B2 . . . Bn) mounted on respective portions of the evaporator are switched to corresponding turned-off states one by one. At this time, a voltage corresponding to a resistance of the thermistor TH is input to the input port P1 of the microcomputer 11 in operation 120. The microcomputer 11 determines whether the input voltage detected through the input port P1 is greater than a set voltage in operation 130. The set voltage is set to determine whether all of the bimetals (B1, B2 . . . Bn) are switched to the corresponding turned-off states.

Where the input voltage is not greater than the set voltage in the operation 130, which illustrates that all of the bimetals (B1, B2 . . . Bn) are not turned off, the microcomputer 11 stands by to continue the defrosting operation.

Where the input voltage is greater than the set voltage in the operation 130, that is, where all of the bimetals (B1, B2 . . . Bn) are switched to the turned-off states, indicative that most of the frost stuck to the evaporator are eliminated, the microcomputer 11 converts the input voltage detected through the input port P1 into digital temperature data, and calculates a defrost temperature on the basis of the digital temperature data in operation 140.

Thereafter, the microcomputer 11 determines whether the calculated defrost temperature corresponds to a temperature set to stop the defrosting operation, that is, a defrosting stop temperature, in operation 150. Where the calculated defrost temperature does not correspond to the defrosting stop temperature, the microcomputer 11 continues the defrosting operation. On the other hand, where the calculated defrost temperature corresponds to the defrosting stop temperature, the microcomputer 11 turns off the defrost heater so as to stop the defrosting operation, in operation 160, and returns to a next operation of, for example, performing cooling operations for respective compartments of the refrigerator.

Figure 4:
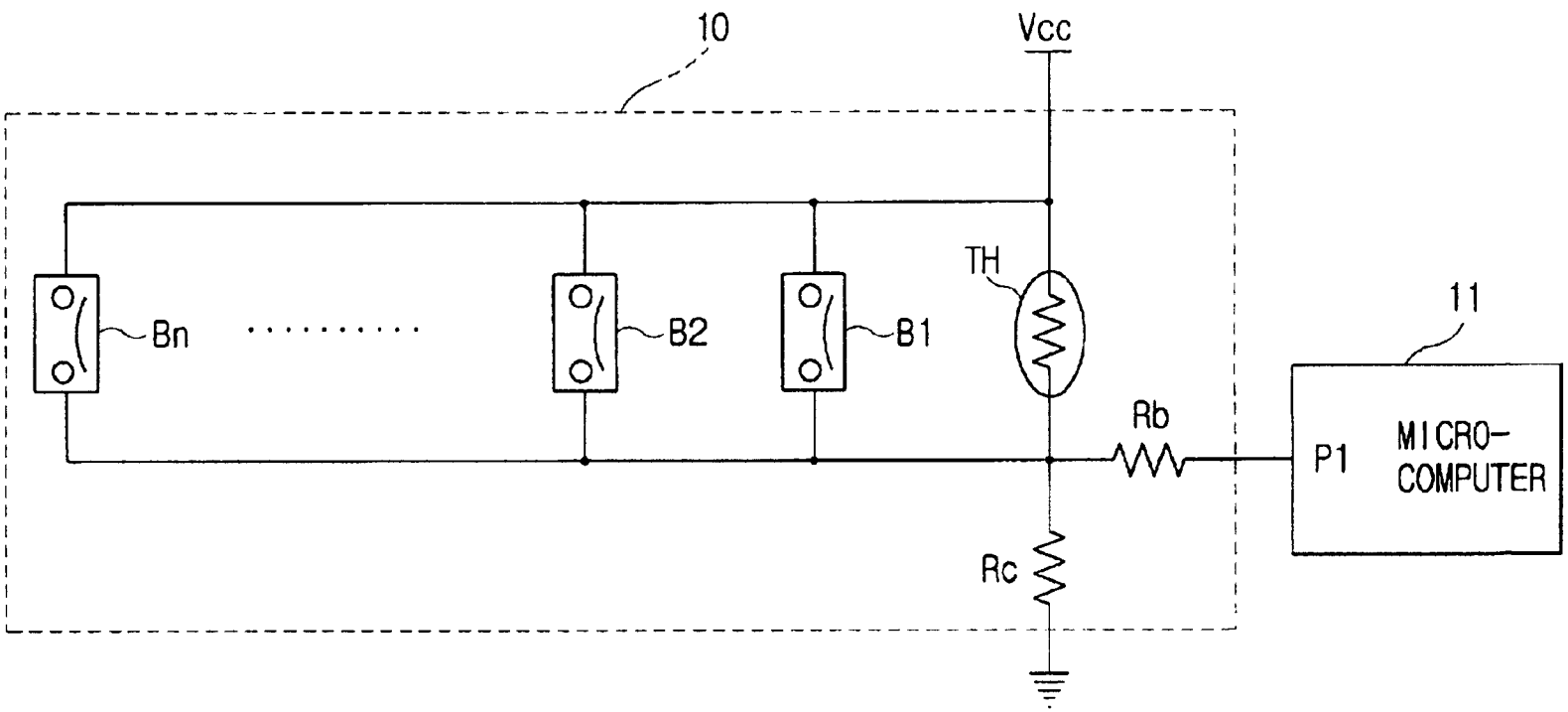
FIG. 4 is a circuit diagram illustrating the construction of a refrigerator according to another embodiment of the present invention.

FIG. 4 shows a circuit diagram illustrating the construction of a refrigerator according to another embodiment of the present invention. In FIGS. 3A and 4, the same reference numerals refer to the same elements throughout. Referring to FIG. 4, one end of each of a single thermistor TH and a plurality of bimetals (B1, B2 . . . Bn) is connected to driving power Vcc, while the other end of each thereof is grounded through a voltage dividing resistor Ra.

In the embodiment of FIG. 4, where the bimetals (B1, B2 . . . Bn) are switched to their corresponding turned-off states, that is, where a defrost temperature of the entire evaporator increases, a microcomputer 11 calculates a voltage input through an input port P1 as a defrost temperature, and finishes a defrosting operation on the basis of the calculated defrost temperature.

Figure 5:
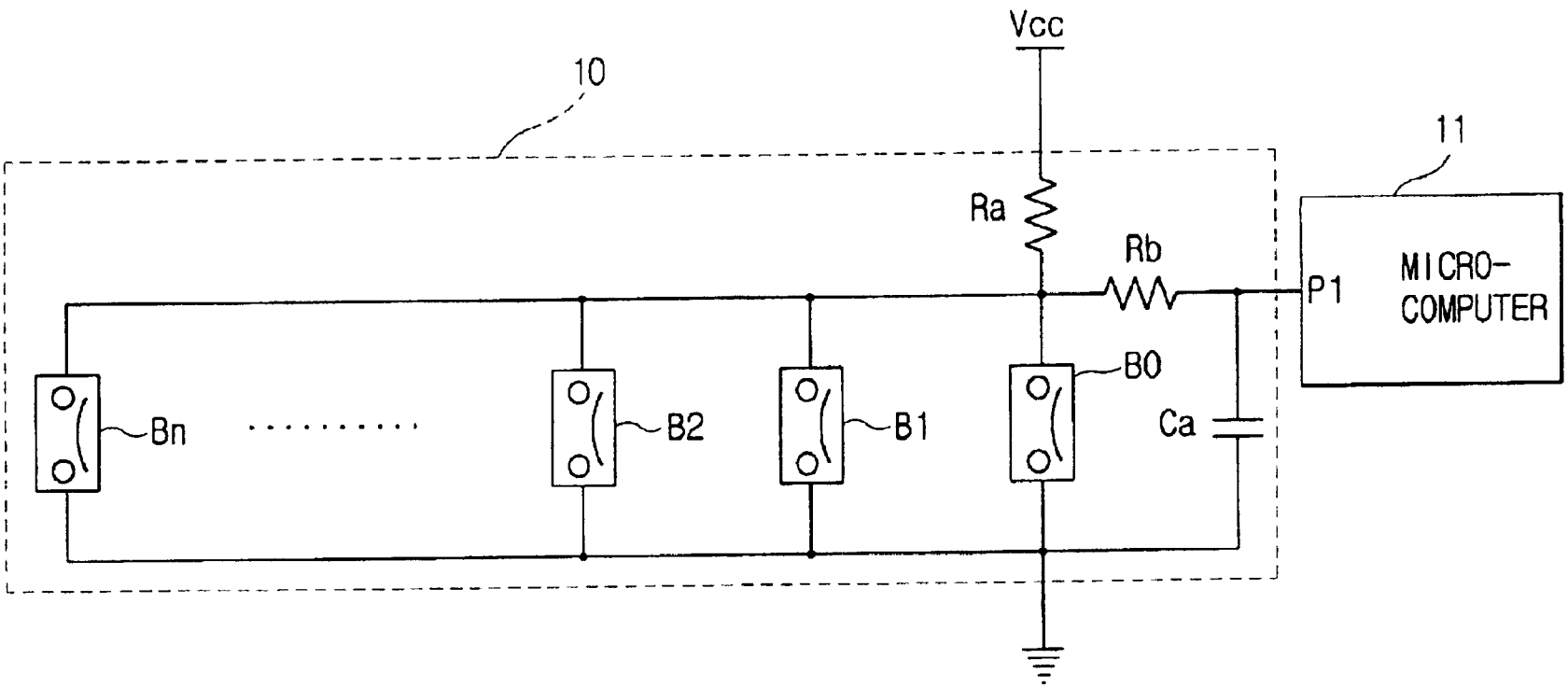
FIG. 5 is a circuit diagram illustrating the construction of a refrigerator according to yet another embodiment of the present invention.

FIG. 5 shows a circuit diagram illustrating the construction of a refrigerator according to yet another embodiment of the present invention. In FIGS. 3A and 5, the same reference numerals refer to the same elements throughout.

Referring to FIG. 5, the refrigerator of this embodiment employs a bimetal B0 instead of a thermistor TH, as shown in FIGS. 3A and 4. The bimetal B0 is mounted at a position where a defrost temperature is increased later than the remaining bimetals (B1, B2 . . . Bn). Since a bimetal is generally more advantageous in terms of price, it can be used instead of a thermistor to reduce the cost.

Each of the bimetals (B0, B1, B2 . . . Bn) has one end connected to driving power Vcc through a voltage dividing resistor Ra, and the other end connected to a ground.

Where even a single bimetal maintains its turned-on state during the defrosting operation, a voltage input to an input port P1 of a microcomputer 11 is maintained at the same state as that of an initial stage of a defrosting operation. That is, where the input voltage detected through the input port P1 of the microcomputer 11 is not greater than a set voltage, the defrosting operation is continued.

Where the defrost temperature increases, and all of the bimetals (B0, B1, B2 . . . Bn) are switched to corresponding turned-off states, the input voltage detected through the input port P1 of the microcomputer 11 is greater than the set voltage, and therefore, the microcomputer 11 recognizes the defrost temperature of the entire evaporator to be increased. Accordingly, the microcomputer 11 stops an operation of the defrost heater so as to finish the defrosting operation.

As described above, the present invention provides a refrigerator having inexpensive temperature sensing devices, for example, bimetals, which sense a defrost temperature. Accordingly, the manufacturing cost of the refrigerator is reduced. Furthermore, a microcomputer of the refrigerator is adopted to have a single common input port for the temperature sensing devices. Therefore, a circuit construction thereof is simplified.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A refrigerator which performs a cooling operation and a defrosting operation, comprising:

an evaporator to perform the cooling operation;

a defrost temperature sensing unit which includes a plurality of temperature sensing devices, wherein:

the temperature sensing devices are mounted on the evaporator to be spaced apart from each other, and the defrost temperature sensing unit senses a defrost temperature using the temperature sensing devices; and a microcomputer having a common input port which receives the defrost temperature detected by the defrost temperature sensing unit.

2. The refrigerator according to claim 1, wherein the defrost temperature sensing unit is implemented by the temperature sensing devices having the same operating characteristics.

3. The refrigerator according to claim 2, wherein the temperature sensing devices are bimetals which are selectively turned on and off according to the defrost temperature.

4. The refrigerator according to claim 1, wherein the defrost temperature sensing unit is implemented by the temperature sensing devices having different operating characteristics.

5. The refrigerator according to claim 4, wherein the temperature sensing devices are respectively a thermistor having a resistance which is varied according to the defrost temperature, and at least one bimetal which is selectively turned on and off according to the defrost temperature.

6. The refrigerator according to claim 5, wherein the thermistor and the at least one bimetal are electrically connected in parallel with each other.

7. The refrigerator according to claim 6, wherein the defrost temperature sensing unit further includes a voltage diving resistor, through which a first end of each of the thermistor and the at least one bimetal is connected to driving power, and a potential to which a second end of the each of the thermistor and the at least one bimetal is connected.

8. The refrigerator according to claim 6, wherein:

each of the thermistor and the at least one bimetal has a first end connected to driving power, and the defrost temperature sensing unit further includes a voltage diving resistor through which a second end of the each of the thermistor and the at least one bimetal is connected to a potential.

9. The refrigerator according to claim 5, wherein the thermistor is arranged on an area of the evaporator where a defrost temperature of the thermistor is increased later than those of the bimetals.

10. A method of controlling a refrigerator which senses a defrost temperature using a plurality of temperature sensing devices, which are mounted on an evaporator to be spaced apart from each other, and performs a defrosting operation to defrost the evaporator according to a control of a microcomputer having a common input port to receive the sensed defrost temperature, the method comprising:

determining operating states of the temperature sensing devices on the basis of the defrost temperature input through the common input port in the defrosting operation; and stopping the defrosting operation in response to the defrost temperature corresponding to defrosting stop conditions on the basis of determined results for the operating states of the temperature sensing devices.

11. The refrigerator control method according to claim 10, wherein the operation states of the temperature sensing devices are determined according to the defrost temperature of the evaporator.

12. The refrigerator control method according to claim 10, wherein the defrosting stop conditions are conditions which determine whether a sensed defrost temperature corresponds to a set defrosting stop temperature, as the defrost temperature of the entire evaporator increases.

13. The refrigerator according to claim 1, wherein:

the temperature sensing devices are electrically connected in parallel with each other, and the defrost temperature sensing unit further includes a voltage dividing resistor, through which a first end of each of the temperature sensing devices is connected to driving power, and a potential to which a second end of the each of the temperature sensing devices is connected.

14. The refrigerator according to claim 13, wherein the defrost temperature sensing unit further includes a voltage stabilizing unit having a resistor and a capacitor which drop a voltage divided by the voltage diving resistor and stabilize the voltage.

15. The refrigerator according to claim 1, further comprising a defrost heater which generates heat to defrost the evaporator, wherein:

the temperature sensing devices are respectively a thermistor having a resistance which is varied according to the defrost temperature, and one or more bimetals which is selectively turned on and off according to the defrosting temperature, and the microcomputer drives the defrost heater in response to one of the one or more bimetals being turned on.

16. The refrigerator according to claim 15, wherein:

the one or more bimetals are turned off in response to the defrosting temperature being increased to a predetermined temperature, and the microcomputer maintains or stops the defrosting operation in response to all of the one or more bimetals being turned off and according to a voltage corresponding to the resistance of the thermistor.

17. The refrigerator according to claim 16, wherein the microcomputer recognizes a temperature corresponding to the voltage, determines whether the temperature corresponds to defrosting stop conditions of the refrigerator by comparing the temperature with a set temperature, and operates the defrost heater according to the determination.

18. The refrigerator according to claim 15, wherein the microcomputer calculates a voltage input through the common input port as the defrost temperature and finishes the defrosting operation according to the calculated defrost temperature, in response to all of the one or more bimetals being turned off.

19. The refrigerator according to claim 3, further comprising a defrost heater which generates heat to defrost the evaporator, wherein:

the bimetals are electrically connected in parallel with each other, the defrost temperature sensing unit further includes a voltage dividing resistor, through which a first end of each of the bimetals is connected to driving power, and a potential to which a second end of the each of the bimetals is connected, and the microcomputer drives the defrost heater in response to one of the bimetals being turned on and a voltage input through the common input port is not greater than a set voltage, and stops the defrost heater in response to all of the bimetals being turned off and the voltage being greater than the set voltage.

20. A method of controlling a refrigerator which senses a defrost temperature using a plurality of temperature sensing devices, which are mounted on an evaporator to be spaced apart from each other, and performs a defrosting operation to defrost the evaporator according to a control of a microcomputer having a common input port to receive the sensed defrost temperature, the method comprising:

determining whether a voltage detected through the common input port is greater than a set voltage, wherein the set voltage is indicative of whether all but one of the temperature sensing devices are switched off;

calculating the defrost temperature in response to the voltage being greater than the set voltage; and stopping the defrosting operation in response to the calculated defrosting temperature corresponding to a predetermined defrost stop temperature.

21. The method according to claim 20, wherein the calculating of the defrost temperature comprises:

converting the voltage into temperature data; and determining the defrost temperature according to the temperature data.

22. The method according to claim 20, further comprising continuing the defrosting operation in response to the voltage not being greater than the set voltage.

23. The method according to claim 20, further comprising continuing the defrosting operation in response to the calculated defrosting temperature not corresponding to the predetermined defrost stop temperature.

24. The refrigerator according to claim 7, wherein the potential is an electrical ground.

25. The refrigerator according to claim 8, wherein the potential is an electrical ground.

26. The refrigerator according to claim 13, wherein the potential is an electrical ground.

27. The refrigerator according to claim 19, wherein the potential is an electrical ground.

* * * * *